United States Patent [19]

Shiba et al.

[11] 3,947,275

[45] Mar. 30, 1976

[54] SPECTRALLY SENSITIZED SILVER HALIDE PHOTOGRAPHIC EMULSION

[75] Inventors: Keisuke Shiba; Akira Sato; Akira Ogawa, all of Minami-ashigara, Japan

[73] Assignee: Fuji Photo Film Co., Ltd., Minami-ashigara, Japan

[22] Filed: Nov. 21, 1973

[21] Appl. No.: 417,841

Related U.S. Application Data

[63] Continuation-in-part of Ser. No. 139,331, May 3, 1971, abandoned.

[52] U.S. Cl. ..... 96/124; 96/137

[51] Int. Cl.[2] ..... G03C 1/14

[58] Field of Search ..... 96/124

[56] References Cited

UNITED STATES PATENTS

| | | | |
|---|---|---|---|
| 2,973,264 | 2/1961 | Nys et al. | 96/124 |
| 3,173,791 | 3/1965 | Kalenda | 96/124 |
| 3,672,898 | 6/1972 | Schwan et al. | 96/124 |
| 3,769,025 | 10/1973 | Ohkubo et al. | 96/124 |
| 3,794,498 | 2/1974 | Yao | 96/124 |

*Primary Examiner*—J. Travis Brown

*Attorney, Agent, or Firm*—Sughrue, Rothwell, Mion, Zinn & Macpeak

[57] ABSTRACT

A sensitized gelatino-silver halide emulsion comprising a supersensitizing combination of at least one sensitizing dye represented by general formula I:

(I)

wherein $R_1$, $R_2$ and $R_3$ are each a member selected from the group consisting of an alkyl having up to 6 carbon atoms and a substituted alkyl group having up to 6 carbon atoms, at least one of $R_1$, $R_2$ and $R_3$ being a substituted alkyl group having a sulfo group therein; $R_4$ is a hydrogen atom or forms an alkylene linkage together with $R_2$; $Z_1$ is an atomic group necessary for completing a benzimidazole nucleus; $A_1$ and $A_2$ are each a member selected from the group consisting of a hydrogen atom, a phenyl group, a halogen atom, a carboxyl group, an alkoxy carbonyl group, an alkyl group, an alkoxyl group, a hydroxyl group, a trifluoromethyl group, and a cyano group, $A_2$ being capable of condensing with $A_1$ or $A_3$ to form a benzene nucleus; and $A_3$ is a member selected from the group consisting of a hydrogen atom and an alkyl group; at least one substituent for $A_1$, $A_2$ or $A_3$ entering the benzoxazole nucleus when $R_2$ and $R_4$ are bridged by an alkylene group and $Z_1$ is substituted with identical halogen atoms; and at least one of sensitizing dyes represented by general formula II:

(II)

in which $R_5$, $R_6$, $R_7$ and $R_8$ have the same meaning as those of $R_1$, $R_2$ and $R_3$ above and additionally are a carbamoylalkyl group, at least one of $R_5$, $R_6$, $R_7$ and $R_8$ being a substituted alkyl group having a member selected from the group consisting of a sulfo group and a carboxyl group; $Z_2$ and $Z_3$ are atomic groups necessary for forming a benzimidazole nucleus; $X^-$ is an acid anion and $n$ is an integer of from 1 to 2, $n$ being 1 when an intramolecular salt is formed.

17 Claims, 3 Drawing Figures

SPECTRALLY SENSITIZED SILVER HALIDE PHOTOGRAPHIC EMULSION

CROSS-REFERENCE TO RELATED APPLICATIONS

This application is a continuation-in-part application of co-pending application Ser. No. 139,331, filed May 3, 1971.

BACKGROUND OF THE INVENTION

1. Field of the Invention

This invention relates to a spectrally sensitized photographic gelatino-silver halide emulsion and more particularly, it is concerned with a photographic silver halide emulsion suitable for use as a color sensitive material, in which the green sensitivity is raised by the combined use of at least two sensitizing dyes.

2. Description of the Prior Art

In the production of light-sensitive materials, as is well known, the spectral sensitizing technique is very important and essential for the production of color light-sensitive materials. Of the blue-sensitive, green-sensitive and red-sensitive silver halide photographic emulsions which compose a color light-sensitive material, the property of the green-sensitive silver halide emulsion affects markedly the quality of a color photograph. That is to say, a slight difference of the green sensitivities or the distribution of spectral sensitivity in the green region affects markedly the color reproduction of a color light-sensitive material and the quality of a color image. Therefore, the spectral sensitization of green region is a problem in which those working in light-sensitive materials make detailed studies with care.

It is known that the spectral sensitization of a light-sensitive material is affected by various properties of a silver halide emulsion used; for example, the crystal habit of the silver halide, the grain size, the halogen composition, its chemical sensitization, its pH and the concentration of silver ion, by the kinds of binders and additives such as antifoggants, stabilizers and coating agents and, in the case of the color material, of the incorporated type, by a coupler, a coupler dispersing agent, a plasticizer, a hardener and dyestuffs for photography. These are inclined to act so as dyes weaken the spectral sensitization. The spectral sensitivity of a light-sensitive material depends largely on not only the chemical structure of the sensitizing dye used but the addition method to an emulsion used. Sensitizing dyes are used alone in some cases, buut, in many cases, two or more sensitizing dyes are used in combination in order to obtain a suitable distribution of spectral sensitivity. The spectral sensitivity obtained when dyess are used in combination is ordinarily not higher than the maximum spectral sensitivity obtained when the dyes are used alone. However, in a particular case of using certain sensitizing dyes in combination, a higher spectral sensitivity can be superadditively obtained. This is called supersensitization. It is also known that combinations of two or more sensitizing dyes to give this supersensitization are so selective with each other that it is very difficult to estimate their actions from the difference of the apparent chemical structures.

The supersensitizing technique for color light-sensitive materials in the green region has been studied by many researchers. However, the prior art has many disadvantages.

SUMMARY OF THE INVENTION

The principal object of this invention is to provide a photographic silver halide emulsion in which the spectral sensitivity over the range of 500 nm to 530 nm is increased while holding the maximum sensitizing wavelength over the range of 540 nm to 570 nm being within a range of wavelengths of from 490 nm to 590 nm, this being the green region, and of which the sensitivity-lowering due to coexistence of a coupler is small.

The second object is to lessen the staining due to residual dyes remaining after development processing as much as possible.

In Japanese Pat. No. 4936/1968 it is disclosed that a super-sensitizing combination of benzimidazolecarbocyanine and oxacarbocyanine can be employed. This method, however, had a disadvantage in that there is much color staining due to the sensitizing dyes and the spectral sensitivity over the short wavelength side of the green region which is relatively insufficient, for example, from 500 nm to 530 nm. The method disclosed in Japanese Pat. No. 22884/1968 has also a disadvantage in that the relative spectral sensitivity over the short wavelength side is insufficient. In the method disclosed in British Pat. No. 852,915, there is much color staining and the sensitivity is low; in particular, the spectral sensitivity over the range of 500 nm to 530 nm is insufficient. The sensitivity of such a light-sensitive material is due to the coexistence of a coupler. This is mainly due to the defect on the chemical structure of the sensitizing dye represented by general formula II as disclosed in said British patent. The method disclosed in U.S. Pat. No. 3,173,791 makes it possible to shift the maximum spectral sensitization wavelength to a position intermediate between those obtained by two dyes but, by this method, it is difficult to increase the sensitivity of the short wavelength side while holding the maximum sensitization wavelength within the range of 540 to 570 nm. This is unsatisfactory for the object of this invention.

We, the inventors, have found that these disadvantages can be overcome by the following method. That is to say, the object of the invention can be accomplished by incorporation in a photographic silver halide emulsion, a sensitizing amount of at least one benzimidazoloxacarbocyanine dye represented by general formula I:

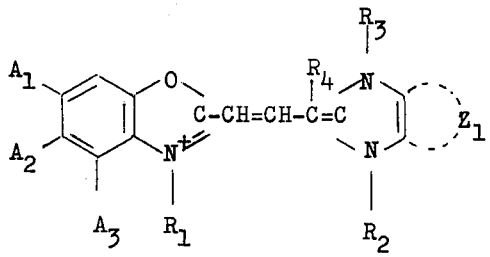

(I)

wherein $R_1$, $R_2$ and $R_3$ are each an alkyl group (i.e., unsubstituted alkyl groups and substituted alkyl groups) said alkyl moiety having preferably up to 6 carbon atoms, such as methyl, ethyl and propyl groups, hydroxyalkyl groups, e.g. hydroxyethyl, acetoxy alkyl groups, e.g. acetoxypropyl, acetoxyethyl, aralkyl e.g. benzyl, carboxyalkyl groups, e.g. carboxyethyl and methylsulfonylaminoethyl groups, substituted alkyl groups having a sulfo group thereon, e.g. γ-sulfopropyl, δ-sulfobutyl and γ-sulfobutyl groups, 2-(3-sulfopropoxy)ethyl, 2-[2-(3-sulfopropoxy)ethoxy]-ethyl and 2-hydroxy-3-sulfopropyl, and an allyl group, at least one of $R_1$, $R_2$ and $R_3$ being an alkyl group containing a sulfo group to form a betaine type structure; $R_4$ is a hydrogen atom or forms an alkylene linkage together with $R_2$; $Z_1$ is an atomic group necessary for completing a benzimidazole nucleus and may be substituted with alkylsulfonyl, alkylsulfamoyl, N-disubstituted aminosulfonyl, alkylcarbamoyl, N-disubstituted carbamoyl, cyano, trifluoromethyl, alkoxycarbonyl group or halogen atom; $A_1$ and $A_2$ are a hydrogen atom, phenyl group, halogen atom, carboxyl, alkoxycarbonyl, alkyl, alkoxy and, hydroxyl and a trifluoromethyl group; $A_2$ being capable of condensing with $A_1$ or $A_3$ to form a benzene nucleus; and $A_3$ is hydrogen atom or an alkyl group, but when $R_4$ and $R_2$ are bridged and $Z_1$ is substituted with identical halogen atoms, at least one of the above-mentioned substituents enters a benzoxazole nucleus; and at least one of imidazolocarbocyanine dyes represented by general formula II:

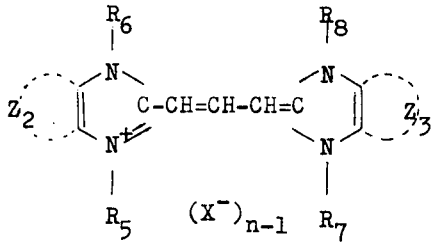

(II)

wherein $R_5$,$R_6$, $R_7$ *and* $R_8$ are each identically defined as those of $R_1$, $R_2$ and $R_3$ in general formula I and additionally can be a carbamoylalkyl group (e.g., an unsubstituted carbamoylalkyl group, an alkyl-substituted carbamoyl group such as a methylcarbamoyl group, etc., and at least one of $R_5$, $R_6$, $R_7$ and $R_8$ is a substituted alkyl group having a sulfo or carboxy group; $Z_2$ and $Z_3$ are atomic groups necessary for completing a benzimidazole nucleus as described for $Z_1$; $X^-$ is an acid anion employed usually in cyanine chemistry, such as halide, perchlorate, p-toluenesulfonate, benzenesulfonate, thiocyanate, ethylsulfate and methylsulfate ion, $n$ is an integer of 1 or 2, but when $n = 1$, an intramolecular salt is formed.

BRIEF DESCRIPTION OF THE ACCOMPANYING DRAWINGS

FIGS. 1–3 are spectrograms of samples produced in the Examples hereinafter.

DETAILED DESCRIPTION OF THE INVENTION

Figure 1:
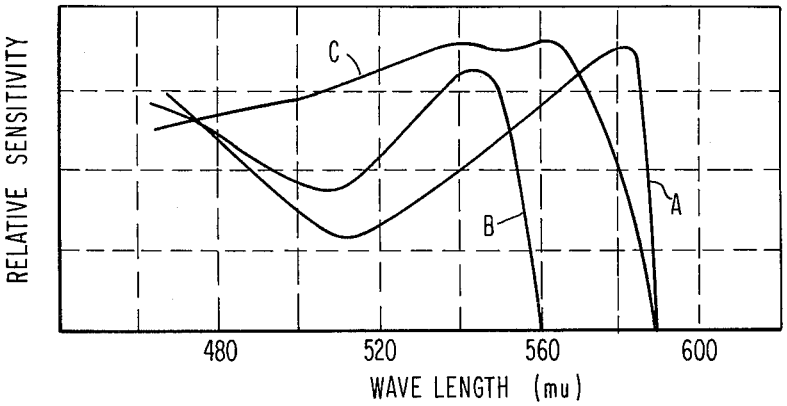

The feature of this invention resides in the dye represented by general formula I in that at least one of $Z_1$ and the benzoxazole nucleus is substituted by a substituent to weaken formation of a J-aggregate, and, when $Z_1$ is substituted by the same halogen atoms, $A_1$ and/or $A_2$ are substituted by halogen atoms, phenyl, carboxyl, alkoxycarboxyl, trifluoromethyl, alkoxy, hydroxy, and cyano groups. Functions finely partitioning suitably the J-aggregate of the sensitizing dye of general formula II and raising the spectral sensitivity on the short wavelength side of the range from 500 to 530 nm, is accomplished by a suitable combination of the substituents of the benzimidazole nucleus with $A_1$, $A_2$ and $A_3$ in the sensitizing dye of general formula I. The color staining due to sensitizing dyes is reduced and a high sensitivity is given by at least one of the sulfo groups in any of $R_1$, $R_2$ and $R_3$, even though bulky substituents enter the benzoxazole nucleus. In particular, this tendency is remarkable in a case where a coupler is coexistent.

The sensitizing dye represented by general formula II is known and includes the benzimidazolocarbocyanine dyes mentioned in Japanese Pat. Nos. 4936/1968, 228/1968, 2530/1969 and 1658/1969.

Examples of the sensitizing dyes applicable to this invention are shown below:

(I-A)

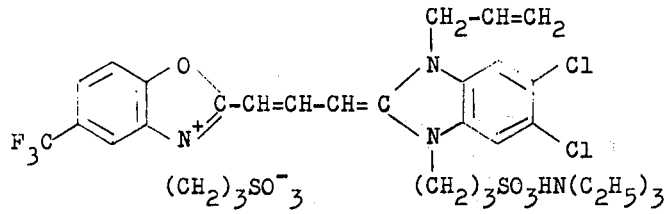

(I-B)

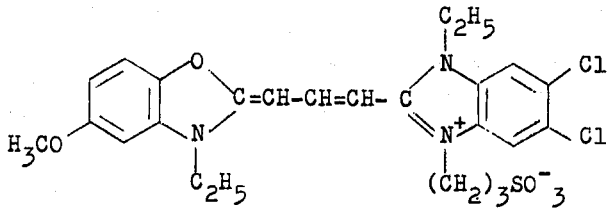

(I-C)
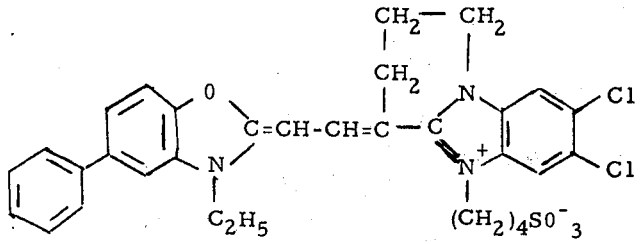
(I-D)
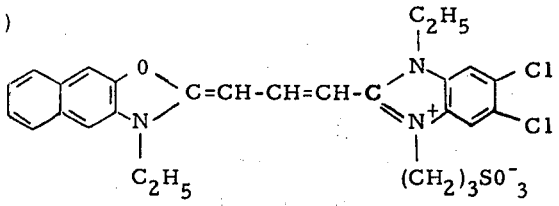
(I-E)
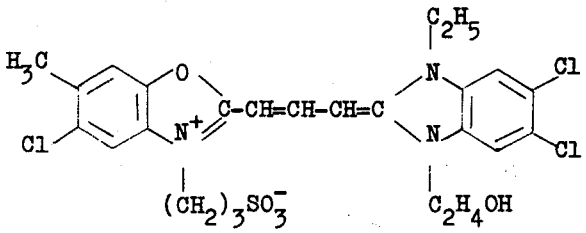
(I-F)
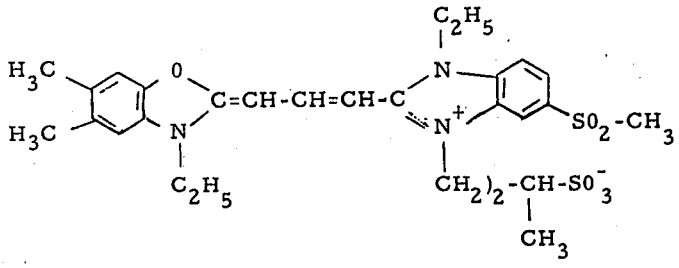
(I-G)
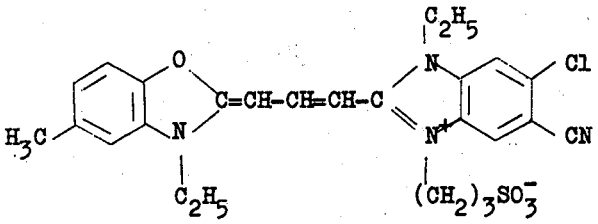
(I-H)
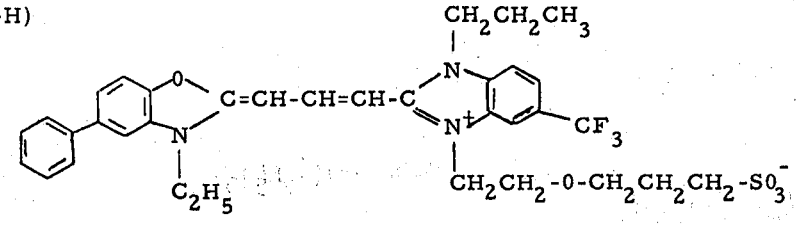

(I-I)
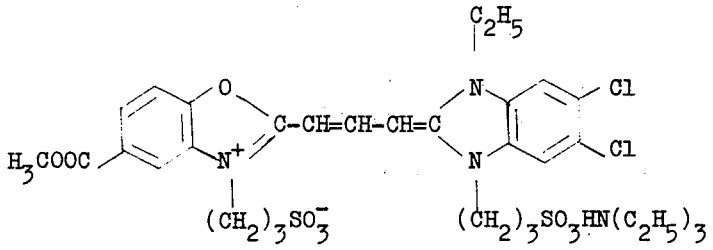
(I-J)
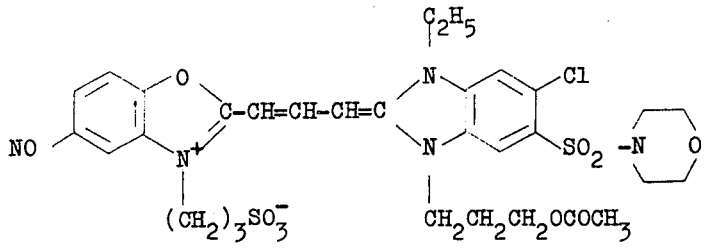
(I-K)
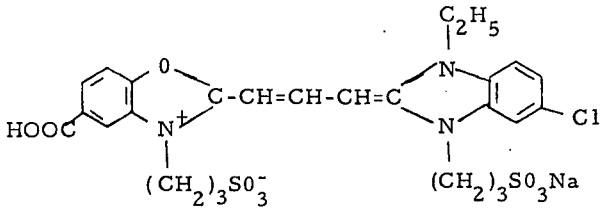
(I-L)
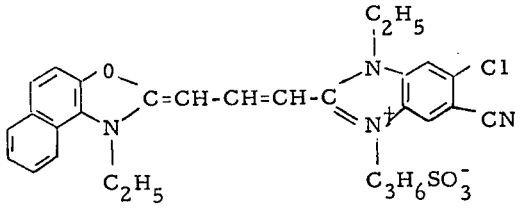
(II-A)
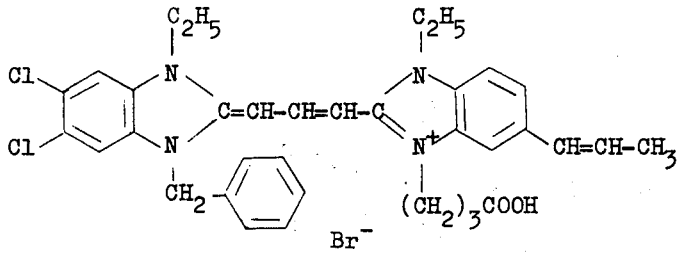
(II-B)
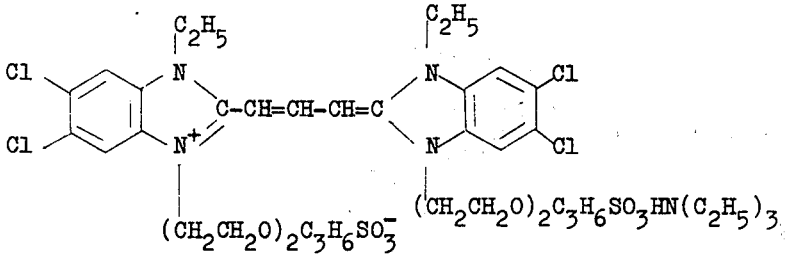

(II-C)
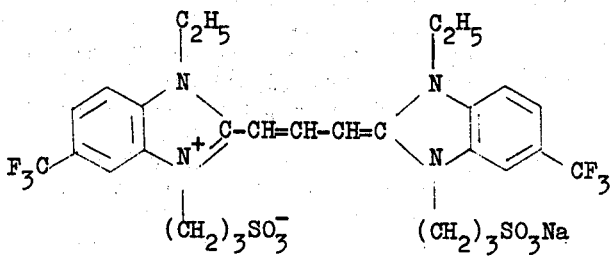
(II-D)
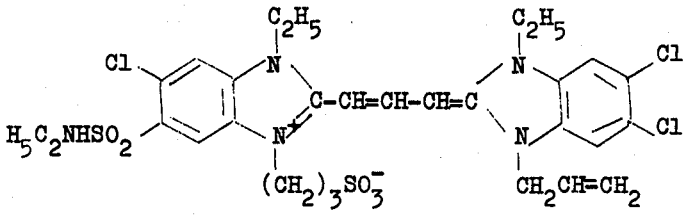
(II-E)
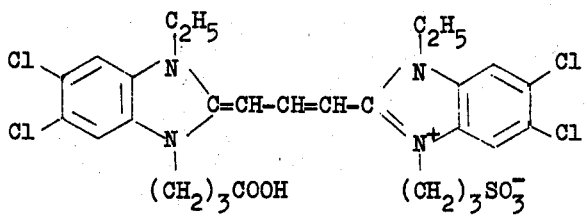
(II-F)
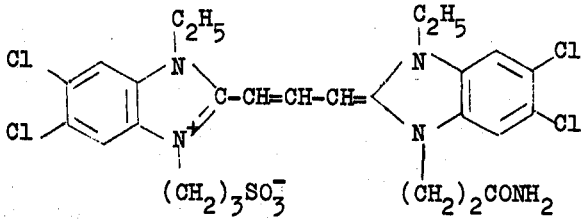
(II-G)
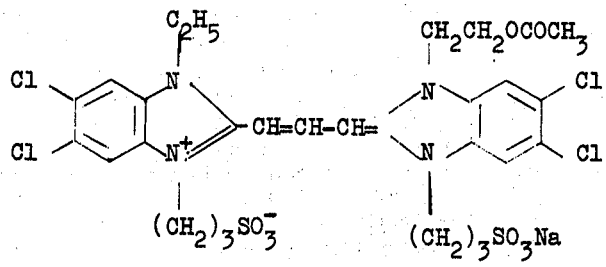

The synthesis of the sensitizing dyes used in this invention will now be illustrated.

Benzimidazoloxacarbocyanine represented by general formula I can be readily synthesized by the method mentioned in, for example, Japanese Pat. No. 14030/1969 and the symmetric or asymmetric benzimidazolocarbocyanines represented by general formula II can be readily synthesized by the method mentioned in Japanese Pat. Nos. 27166/1967, 4931/1968, 14497/1968, 16589/1969 or 13823/1968.

Typical synthesis examples of the benzimidazoloxacarbocyanines represented by general formula I are as follows:

Dye (I-B)

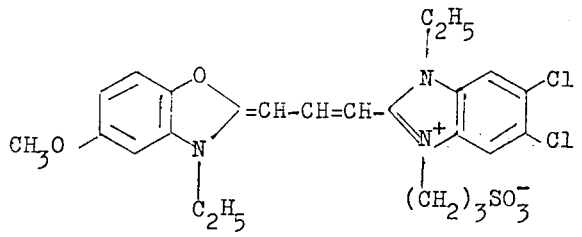

Two g of 2-(2-anilinovinyl)-3-ethyl-5-methoxybenzoxazolium iodide is heated and refluxed for 5 minutes in 2 ml of acetic anhydride and 20 ml of nitrobenzene. To this solution are added 2 g of anhydro-5, 6-dichloro-1-ethyl-2-methyl-3-(γ-sulfopropyl)benzimidazolium hydroxide and 2 ml of triethylamine and heated with refluxing for 10 minutes and thus reacted. After cooling, ether is added to precipitate a dye. The dye is filtered, washed with water and recrystallized from a mixed solvent of methanol-chloroform.

Yield: 0.8 g; M.P. 291°C; $\lambda_{max}^{methanol}$ 495 mμ

Dye (I-I)

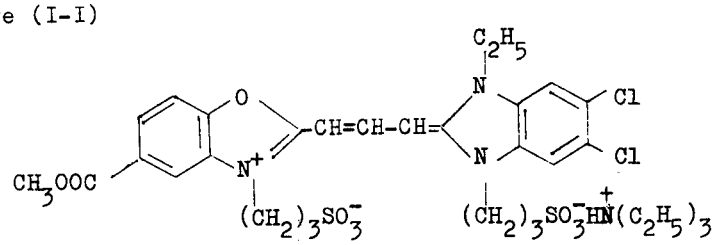

Two g of anhydro-2-(2-anilinovinyl)-5-methoxycarbonyl-3-(3-sulfopropyl)benzoxazolium hydroxide is heated and refluxed for 5 minutes in 2 ml of acetic anhydride and 20 ml of nitrobenzene. To this solution are added 1.8 g of anhydro-5,6-dichloro-1-ethyl-2-methyl-3-(3-sulfopropyl)benzimidazolium and 2 ml of triethylamine. The mixture is heated with refluxing for 10 minutes and thus reacted. After cooling, ether is added to precipitate a dye, followed by crystallizing from isopropanol and recrystallizing from a mixed solvent of methanol-isopropanol.

Yield: 0.7 g; M.P. 210°C; $\lambda_{max}^{methanol}$ 484 mμ

The sensitizing dyes used in this invention are dissolved in water or a water-soluble organic solvent, such as methanol, ethanol, pyridine, acetone or methyl cellosolve and then added to a silver halide emulsion. The sensitizing dyes represented by general formulas I and II may be added to a silver halide emulsion in the form of a solution individually or in admixture. Dissolving of the sensitizing dyes may be carried out with agitation by ultrasonic wave. The amount used varies with the emulsion employed. Ordinarily an amount of $1 \times 10^{-6}$ to $1 \times 10^{-3}$ moles per one mole of silver halide is preferred. The molar ratio of the amounts of the sensitizing dye represented by general formula I and that represented by general formula II is 1:10 to 10:1 and preferably 1:1 to 8:1. The silver halide emulsion used in this invention includes, for example, silver iodobromide, silver chlorobromide, silver bromide and silver iodobromochloride emulsions. Although gelatino-silver halide emulsions are suitable, other emulsions may be used containing polyvinyl alcohol, alginate polymer, polyvinylimidazole, polyvinylpyrrolidone and their copolymers.

The present invention is applicable also to emulsions containing sensitizing dyes and additives, such as dyestuffs for photography, antifoggants, stabilizers, chemical sensitizers, couplers, plasticizers and coating agents. The silver halide emulsion obtained according to this invention is coated onto a suitable support, depending on its use, such as baryta paper, glass, cellulose triacetate film, polyethylene terephthalate film, other plastic films, resin laminated paper and synthetic paper.

The following examples are given in order to illustrate the invention in detail. They are merely intended to be illustrative and not limitative of the same.

EXAMPLE 1

One kg of a silver iodobromide emulsion (iodide-content 4 mole %) prepared in conventional manner was weighed into a suitable vessel and melted. Predetermined amounts of given sensitizing dyes were added with agitation thereto and allowed to stand at 40°C for 15 minutes. Then a hardener and coating agent were added and coated onto a film uniformly to give a thickness of 7.0 microns. The sensitizing dyes were changed as shown in Table I to obtain green-sensitive light-sensitive materials.

The resulting sample was cut to strips and subjected to wedge exposure of yellow light using a light source of a color temperature of 5400°K through No. K-12 Filter (made by Fuji Photo Film Co., Ltd.). Then it was developed at 80°C ± 0.2°C for 10 minutes with a developer having the following composition:

| Developer | |
|---|---|
| water | 500 ml |
| metol | 0.3 g |
| potassium metabisulfite | 1.4 g |
| anhydrous sodium sulfite | 38 g |
| hydroquinone | 6 g |
| sodium carbonate monohydrate | 22.5 g |
| citric acid | 0.7 g |
| potassium bromide | 0.9 g |
| water to 1000 ml | |

The so obtained strip was then subjected to densitometry by means of an S-type densitometer made by Fuji Photo Film Co., Ltd., to obtain a relative spectral sensitivity (green sensitivity) as shown in Table I.

Then the strip was exposed by the use of a spectrograph having inside a reflection type diffraction grating (GR-2 type, made by Narumi Co.) and developed to obtain a spectrogram as shown in FIG. 1. Curve A shows a spectrogram obtained from a sample using the sensitizing dye II-B, Curve B shows that obtained from a sample using the sensitizing dye I-E and Curve C shows that obtained from a sample using the sensitizing dyes II-B and I-E in combination.

Table I

| No. | Dye used | Amount ml (mol) | Dye used | Amount ml (mol) | Relative green sensitivity | Fog | Note |
|---|---|---|---|---|---|---|---|
| 1 | I-A | 40 ($1\times10^{-3}$) | | — | 16 | 0.16 | |
| | | 80 | | — | 16 | 0.21 | |
| | | 160 | | — | 12 | 0.22 | |
| | | — | II-B | 40 ($5\times10^{-4}$) | 100 | 0.14 | Curve A of Fig. 1 |
| | | — | | 80 | 95 | 0.16 | |
| | I-A | 40 | | 40 | 120 | 0.20 | |
| | | 80 | | 40 | 120 | 0.20 | |
| | | 120 | | 40 | 126 | 0.23 | |
| 2 | I-B | 40 ($1\times10^{-3}$) | | — | 112 | 0.16 | |
| | | 80 | | — | 125 | 0.16 | |
| | | 160 | | — | 140 | 0.16 | |
| | I-B | 40 | II-B | 40 | 180 | 0.15 | |
| | | 80 | | 40 | 200 | 0.15 | |
| | | 160 | | 40 | 195 | 0.18 | |
| 3 | I-C | 40 ($1\times10^{-3}$) | | — | 25 | 0.14 | |
| | | 80 | | — | 28 | 0.17 | |
| | | — | II-D | — | 100 | 0.19 | |
| | | — | | 80 | 79 | 0.24 | |
| | | 40 | | 40 | 125 | 0.19 | |
| | | 80 | | 40 | 142 | 0.25 | |
| 4 | I-D | 40 ($1\times10^{-3}$) | | — | 32 | 0.13 | |
| | | 80 ($1\times10^{-3}$) | | — | 32 | 0.14 | |
| | | 40 | II-D | 40 | 125 | 0.14 | |
| | | 80 | | 40 | 105 | 0.20 | |
| 5 | I-E | 40 ($1\times10^{-3}$) | | — | 100 | 0.14 | |
| | | 80 | | — | 112 | 0.15 | |
| | | 160 | | — | 112 | 0.14 | Curve B of Fig. 1 |
| 6 | I-E | 40 ($1\times10^{-3}$) | II-B | 40 ($5\times10^{-4}$) | 167 | 0.15 | |
| | | 80 | | 40 | 178 | 0.15 | |
| | | 160 | | 40 | 225 | 0.12 | Curve C of Fig. 1 |
| 7 | I-F | 40 ($1\times10^{-3}$) | | — | 40 | 0.22 | |
| | | 80 | | — | 56 | 0.14 | |
| | I-F | 40 | | 40 ($5\times10^{-4}$) | 159 | 0.25 | |
| | | 80 | | 40 | 112 | 0.23 | |
| 8 | I-G | 40 ($1\times10^{-3}$) | | — | 100 | 0.14 | |
| | | 80 | | — | 126 | 0.16 | |
| | | 160 | | — | 126 | 0.14 | |
| | I-G | 40 | II-B | 40 ($5\times10^{-4}$) | 200 | 0.16 | |
| | | 80 | | 40 | 292 | 0.20 | |
| | | 160 | | 40 | 264 | 0.13 | |
| 9 | I-H | 40 ($1\times10^{-3}$) | | — | 56 | 0.13 | |
| | | 80 | | — | 71 | 0.15 | |
| | I-H | 40 | II-C | 40 ($5\times10^{-4}$) | 85 | 0.15 | |
| | | 80 | | 40 | 120 | 0.18 | |
| | | 160 | | 40 | 100 | 0.18 | |
| | | — | | 40 | 40 | 0.13 | |
| | | — | | 80 | 79 | 0.17 | |
| 10 | I-I | 40 ($1\times10^{-3}$) | | — | 80 | 0.15 | |
| | | 80 | | — | 100 | 0.15 | |
| | | 40 | II-C | 40 | 85 | 0.13 | |
| | | 80 | | 40 | 115 | 0.20 | |
| | | 160 | | 40 | 90 | 0.25 | |
| 11 | I-J | 40 ($1\times10^{-3}$) | | — | 16 | 0.18 | |
| | | 80 | | — | 28 | 0.18 | |
| | | 40 | II-B | 40 | 105 | 0.16 | |
| | | 80 | | 40 | 110 | 0.17 | |
| 12 | I-K | 20 ($1\times10^{-3}$) | | — | 16 | 0.30 | |
| | | 40 | | — | 20 | 0.40 | |
| | | 20 | II-B | 40 | 222 | 0.56 | |
| 13 | I-I | 20 ($1\times10^{-3}$) | II-B | 40 ($5\times10^{-4}$) | 158 | 0.14 | |
| | | 40 | | 40 | 174 | 0.14 | |
| | | 80 | | 40 | 220 | 0.13 | |
| | | 120 | | 40 | 195 | 0.13 | |
| 14 | I-L | 40 ($6\times10^{-4}$) | | — | 60 | 0.13 | |
| | | 80 | | — | 75 | 0.15 | |
| | | 40 | II-A | 20 ($5\times10^{-4}$) | 105 | 0.32 | |
| | | 80 | | 20 | 120 | 0.35 | |
| | | — | II-A | 20 | 75 | 0.30 | |
| | | — | | 40 | 71 | 0.45 | |

EXAMPLE 2

One hundred g of 1-(2,4,6-trichlorophenyl)-3-[3-(2-]2,4-di-t-amylphenoxy]acetamido)benzamide]-5-pyrazolone was dissolved in 100 ml of tricresyl phosphate with heating, added to 1000 g of 10% gelatin solution, to which sodium alkylbenzenesulfonate was added, and dispersed by means of a high speed rotating mixer to obtain a coupler dispersion.

One kg of a silver iodobromide emulsion prepared in conventional manner (iodide content 6 mole %) was weighed into a suitable vessel and molten, to which a predetermined amount of a given sensitizing dye was added with agitation. The emulsion was allowed to stand at 35°C for 30 minutes. Three hundred and fifty g of the coupler dispersion was weighed, added to the emulsion in the molten state, mixed with a hardener and coated onto a film uniformly to give a thickness of 4.0 microns. The coated film was dried to obtain a green-sensitive color light-sensitive material.

The resulting light-sensitive material was cut into strips and exposed in a similar manner to that of Example 1 and developed at 24°C ± 0.2°C for 8 minutes using a color developer having the following composition:

| Color developer | |
|---|---|
| N,N'-diethyl-p-aminoaniline sulfate | 2.0 g |
| sodium sulfite | 2.0 g |
| sodium carbonate monohydrate | 50.0 g |
| hydroxylamine hydrochloride | 1.5 g |
| potassium bromide | 1.0 g |
| water to 1000 ml | |
| (pH 10.8 ± 0.1) | |

Then it was bleached and fixed with the following bleaching solution and fixing solution, and washed with running water.

| | |
|---|---|
| Bleaching solution | |
| red prussiate | 100 g |
| potassium bromide | 20 g |
| water to 1000 ml | |
| (pH 6.9 ± 0.3) | |
| Fixing solution | |
| hypo | 200 g |
| sodium sulfite | 20 g |
| acetic acid (28%) | 45 ml |
| boric acid | 7.5 g |
| potassium alum | 20 g |
| water to 1000 ml | |
| (pH 4.5 ± 0.12) | |

The so obtained strip was then subjected to measurement of green filter density by means of an S-type densitometer to obtain a relative spectral sensitivity (green sensitivity) as shown in Table 2.

Table II

Figure 2:
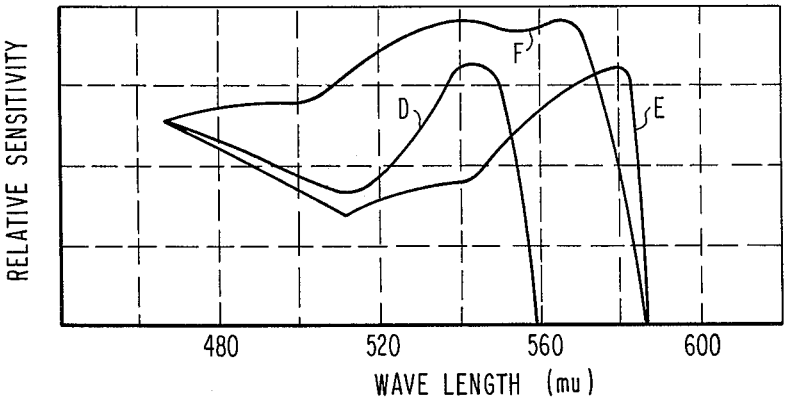

| No. | Dye used | Amount ml (mol) | Dye used | Amount ml (mol) | Relative green sensitivity | Fog | Note |
|---|---|---|---|---|---|---|---|
| 15 | I-I | 40 ($1\times10^{-3}$) | | — | 56 | 0.10 | |
| | | 80 | | — | 80 | 0.12 | |
| | | 160 | | — | 100 | 0.14 | Curve D of FIG. 2 |
| | | — | ii-B | 40 ($5\times10^{-4}$) | 100 | 0.08 | Curve E of FIG. 2 |
| | | — | | 60 | 105 | 0.12 | |
| | I-I | 40 | II-B | 50 | 160 | 0.10 | |
| | | 80 | | 50 | 208 | 0.13 | |
| | | 160 | | 40 | 250 | 0.14 | Curve F of FIG. 2 |

FIG. 2 shows spectrograms in which Curve D shows a spectrogram obtained from a sample using dye I-I, Curve E shows that obtained from a sample using dye II-B and Curve F shows a spectrogram obtained from a sample using dye I-I and dye II-B in combination.

EXAMPLE 3

In order to show the unexpected advantage of the supersensitizing combination of this invention in comparison with Comparison dyes of a similar but different structure, the procedures described in Example 1 were repeated except for the use of silver iodobromide emulsions (0.52 mol of silver/1 Kg emulsion) having an iodide content of 7 mol % (prepared in a conventional manner) and each emulsion contained the carbocyanine dyes set forth in the following Tables III-IV, the comparison dyes had the following structural formulas:

Dye (A)

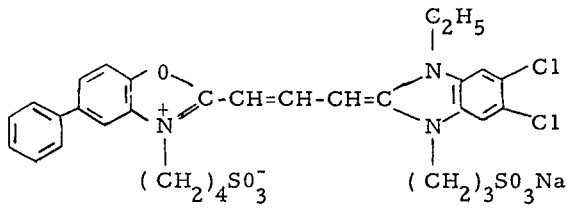

Comparison Dye (B)

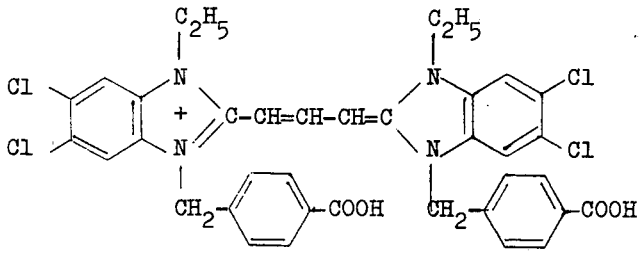

Comparison Dye (C)

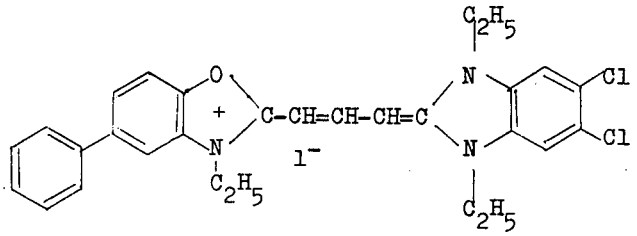

Table III

| Nos. | | Dye used | Addition-Amount ml (mol) | Dye used | Addition-Amount ml (mol) | Relative green* sensitivity | Fog |
|---|---|---|---|---|---|---|---|
| 16 | (i) | A | 40 ($1\times10^{-3}$) | | — | 100 | 0.08 |
| | (ii) | | 80 | | — | 142 | 0.08 |
| | (iii) | | 160 | | — | 151 | 0.09 |
| 17 | (i) | | — | II-B | 40 ($5\times10^{-4}$) | 85 | 0.04 |
| | (ii) | | — | | 80 | 100 | 0.04 |
| 18 | (i) | A | 80 ($1\times10^{-3}$) | II-B | 40 ($5\times10^{-4}$) | 205 | 0.10 |
| | (ii) | | do. | | 80 | 200 | 0.10 |
| 19 | (i) | C | 40 ($1\times10^{-3}$) | | — | 79 | 0.07 |
| | (ii) | | 80 | | — | 87 | 0.08 |
| | (iii) | | 160 | | — | 100 | 0.10 |
| 20 | (i) | | — | B | 40 ($5\times10^{-4}$) | 112 | 0.07 |
| | (ii) | | — | | 80 | 125 | 0.07 |
| 21 | (i) | C | 80 ($1\times10^{-3}$) | B | 40 ($5\times10^{-4}$) | 128 | 0.10 |
| | (ii) | | do. | | 80 | 132 | 0.11 |

*The relative green sensitivity was determined assuming that the green sensitivity of emulsion in Test No. 16 (i) is 100.

Comparison Dye (D)

Dye II-C disclosed in U.S. Pat. No. 2,973,264.

Comparison Dye (E)

Dye II-A disclosed in U.S. Pat. No. 2,973,244.

Comparison Dye (F)

Dye I-B disclosed in U.S. Pat. No. 2,973,244.

Comparison Dye (G)

Dye I-A disclosed in U.S. Pat. No. 2,973,244.

Table IV

| Nos. | | Dye used | Amount ml (mol) | Dye used | Amount ml (mol) | Relative green* sensitivity | Fog |
|---|---|---|---|---|---|---|---|
| 22 | (i) | I-I | 40 ($1\times10^{-3}$) | — | | 35 | 0.07 |
| | (ii) | | 80 | — | | 45 | 0.07 |
| | (iii) | | 160 | — | | 50 | 0.08 |
| | (iv) | | — | II-B | 40 ($5\times10^{-4}$) | 83 | 0.07 |
| | (v) | | — | | 80 | 100 | 0.07 |
| | (vi) | I-I | 40 | | 40 | 126 | 0.06 |
| | (vii)** | | 80 | do. | do. | 142 | 0.07 |
| 23 | (i) | D | 40 ($1\times10^{-3}$) | — | | 66 | 0.07 |
| | (ii) | | 80 | — | | 60 | 0.08 |
| | (iii) | | 160 | — | | 56 | 0.08 |
| | (iv) | | — | F | 40 ($5\times10^{-4}$) | 66 | 0.08 |
| | (v) | | — | | 80 | 60 | 0.08 |
| | (vi) | D | 40 | do. | 40 | 91 | 0.08 |
| | (vii)*** | | 80 | do. | do. | 91 | 0.08 |
| 24 | (i) | E | 40 | — | | 50 | 0.07 |
| | (ii) | | 80 | — | | 60 | 0.08 |
| | (iii) | | 160 | — | | 66 | 0.08 |
| | (iv) | | — | G | 40 ($5\times10^{-4}$) | 79 | 0.12 |
| | (v) | | — | | 80 | 80 | 0.23 |
| | (vi)**** | E | 40 | do. | 40 | 100 | 0.14 |
| | (vii) | | 80 | do. | do. | 110 | 0.23 |

Figure 3:
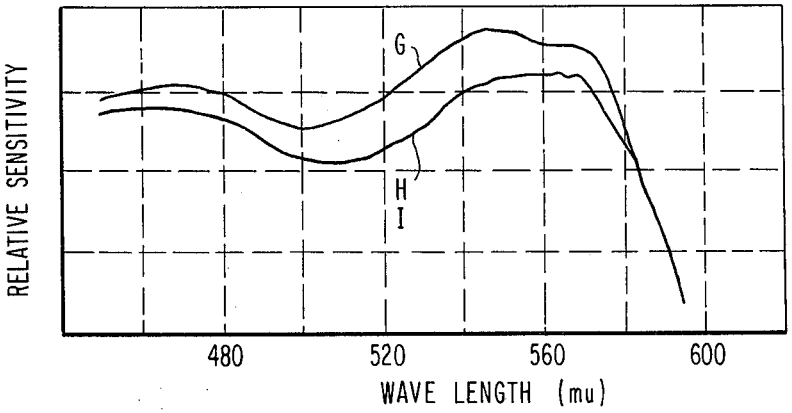

*The relative green sensitivity was determined assuming that the green sensitivity of emulsion in Test No. 22 (iii) was 100.
**Spectrogram FIG. 3 Curve G
***Spectrogram FIG. 3 Curve H
****Spectrogram FIG. 3 Curve I From the results set forth in Tables III and IV above, it can be seen that only with the supersensitizing dye combination of this invention is there an unexpected increase in green-sensitivity.

EXAMPLE 4

The procedures described in Example 1 were repeated using Dyes I-C, II-B and II-E in accordance with this invention and comparison Dyes (H) and (J), corresponding to Dyes II and XI disclosed in U.S. Pat. No. 3,173,791 respectively. The results obtained in these comparison are set out in the Table V recited below.

Table V

| No. | Dye Used | Amount ml (molar concentration) | Dye used | Amount ml (molar concentration) | Relative green-sensitivity | Fog |
|---|---|---|---|---|---|---|
| 1 | Dye(4) | 20($1\times10^{-3}$) 40 (do.) | Dye(J) | — 80($1\times10^{-3}$) | 100 118 | 0.08 0.10 |
| 2 | Dye II-E | (do.) | Dye I-C | 80 (do.) | 155 | 0.10 |
| 3 | Dye II-B | (do.) | do. | do. | 160 | 0.10 |

As can be seen, the dye combination of the present application offered far superior and "unexpected" green-sensitivity over the dye combination of known dyes in the prior art.

Although the present invention has been adequately described in the foregoing specification and examples included therein, it is readily apparent that various changes and modifications may be made without departing from the scope thereof.

What is claimed is:

1. A sensitized gelatino-silver halide emulsion containing a supersensitizing combination of at least one sensitizing dye of the general formula I(*a*):

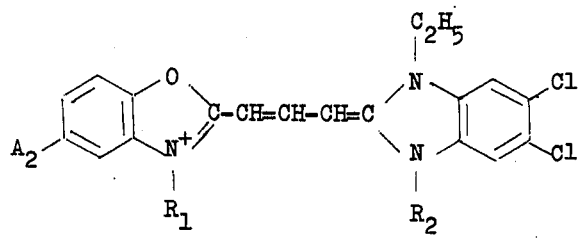

(Ia)

wherein $A_2$ is a member selected from the group consisting of a phenyl group, an alkoxycarbonyl group in which the alkyl moiety thereof has up to 3 carbon atoms, an alkyl group having up to 3 carbon atoms, an alkoxy group, a hydroxy group, a trifluoromethyl group, and a halogen atom; $R_1$ and $R_2$ are each a member selected from the group consisting of an alkyl group having up to 6 carbon atoms and a substituted alkyl group having a sulfogroup thereon in which the alkyl moiety thereof has up to 6 carbon atoms, at least one of $R_1$ and $R_2$ being a substituted alkyl group having a sulfo group thereon; and at least one sensitizing dye of the general formula II(*a*):

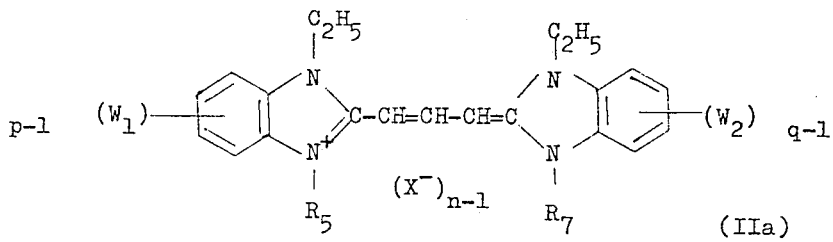

(IIa)

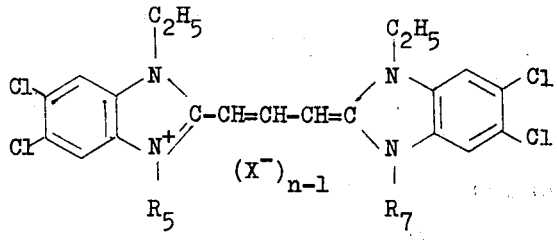

(IIb)

wherein $W_1$ and $W_2$, which may be the same or different, are each a member selected from the group consisting of a halogen atom, an alkoxycarbonyl group, a trifluoromethyl group and a cyano group; *p* and *q* are 1,2 or 3; $R_5$ and $R_7$ are each a member selected form the group consisting of an alkyl group having up to 6 carbon atoms and having a member selected from the group consisting of a sulfo group and a carboxy group thereon; X is an acid anion and *n* is an integer of from 1 to 2, n being 1 when an intramolecular salt is formed.

2. A sensitized gelatino-silver halide emulsion containing a supersensitizing combination of at least one sensitizing dye of the general formula I(*b*):

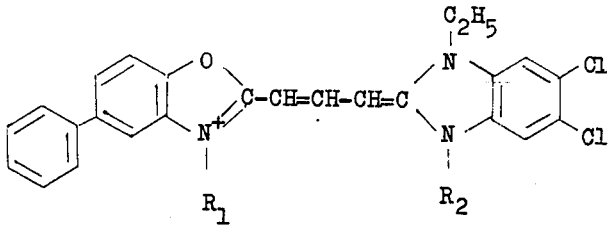

(Ib)

wherein $R_1$ and $R_2$ are each a member selected from the group consisting of an alkyl group having up to 6 carbon atoms, and a substituted alkyl group having a sulfo group thereon, in which the alkyl moiety thereof has up to 6 carbon atoms, at least one of $R_1$ and $R_2$ being a substituted alkyl group having a sulfo group thereon; and at least one sensitizing dye of the general formula II(*b*):

wherein $R_5$ and $R_7$ are each a member selected from the group consisting of an alkyl group having up to 6 carbon atoms and having a member selected from the group consisting of a sulfo group and a carboxy group thereon; X is an acid anion and *n* is an integer of from 1 to 2, *n* being 1 when an intramolecular salt is formed.

3. A sensitized gelatino-silver halide emulsion comprising a supersensitizing combination of at least one sensitizing dye of the general formula I(*c*):

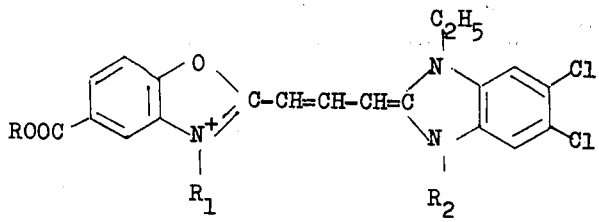

(Ic)

wherein R is an alkyl group, $R_1$ and $R_2$ are each a member selected from the group consisting of an alkyl group, having up to 6 carbon atoms and a substituted alkyl group having a sulfo group thereon in which the alkyl moiety thereof has up to 6 carbon atoms, at least one of $R_1$ and $R_2$ being a substituted alkyl group having a sulfo group thereon, and at least one sensitizing dye of the general formula II(*c*):

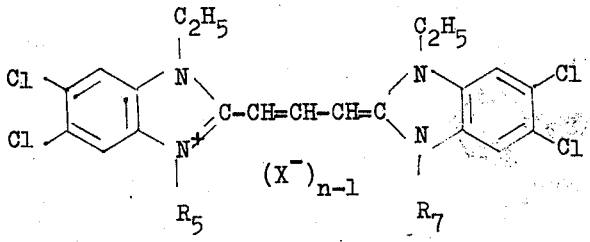

(IIc)

wherein $R_5$ and $R_7$ are each a member selected from the group consisting of an alkyl group having up to 6 carbon atoms and having a member selected from the group consisting of a sulfo group and a carboxy group thereon; X is an acid anion and *n* is an integer of from 1 to 2, being 1 when an intramolecular salt is formed.

4. A light-sensitive photographic element comprising at least one layer containing the sensitized gelatino-silver halide emulsion of claim 1.

5. The sensitized gelatino-silver halide emulsion of claim 1, wherein the amount of the sensitizing dye represented by general formulas I(*a*) and II(*a*) ranges from $1 \times 10^{-6}$ to $1 \times 10^{-3}$ moles per one mole of silver halide.

6. The sensitized gelatino-silver halide emulsion of claim 2, wherein the sensitizing dye represented by general formulas I(*b*) and II(*b*) is present in an amount ranging from $1 \times 10^{-6}$ to $1 \times 10^{-3}$ moles per one mole of silver halide.

7. The sensitized gelatino-silver halide emulsion of claim 3, wherein the sensitizing dye represented by general formulas I(*c*) and II(*c*) is present in an amount ranging from $1 \times 10^{-6}$ to $1 \times {}^{-3}$ moles per one mole of silver halide.

8. The sensitized gelatino-silver halide emulsion of claim 1, wherein the molar ratio of the sensitizing dye represented by general formulas I(*a*) and II(*a*) is 1:10 to 10:1.

9. The sensitized gelatino-silver halide emulsion of claim 2, wherein the molar ratio of the sensitizing dye represented by general formulas I(*b*) and II(*b*) is 1:10 to 10:1.

10. The sensitized gelatino-silver halide emulsion of claim 3, wherein the molar ratio of the sensitized dye represented by general formulas T(*c*) and II(*c*) is 1:10 to 10:1.

11. The sensitized gelatino-silver halide emulsion of claim 1, wherein the molar ratio of the sensitizing dye represented by general formulas I(*a*) and II(*a*) is 1:1 to 8:1.

12. The sensitized gelatino-silver halide emulsion of claim 2, wherein the molar ratio of the sensitizing dye represented by general formulas I(*b*) and II(*b*) is 1:1 to 8:1.

13. The sensitized gelatino-silver halide emulsion of claim 3, wherein the molar ratio of the sensitizing dye represented by general formulas I(*c*) and II(*c*) is 1:1 to 8:1.

14. A light-sensitive photographic element comprising at least one layer containing the sensitized gelatino-silver halide emulsion of claim 2.

15. A light-sensitive photographic element comprising at least one layer containing the sensitized gelatino-silver halide emulsion of claim 3.

16. A sensitized gelatino-silver halide emulsion containing a super-sensitizing combination of at least one sensitizing dye from the group consisting of the dyes under the heading General Formula I below and at least one sensitizing dye from the group under the heading General Formula II below:

General Formula I

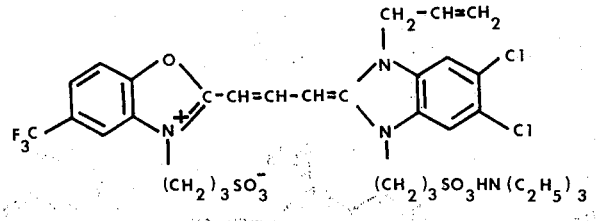

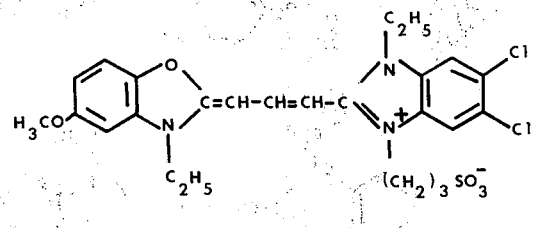

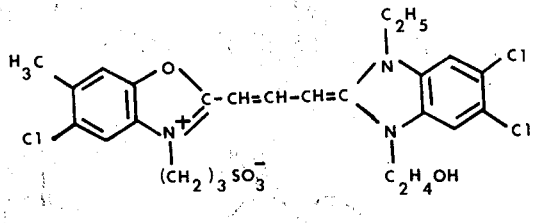

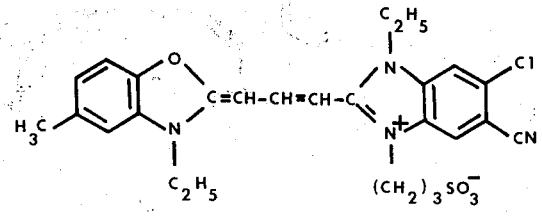

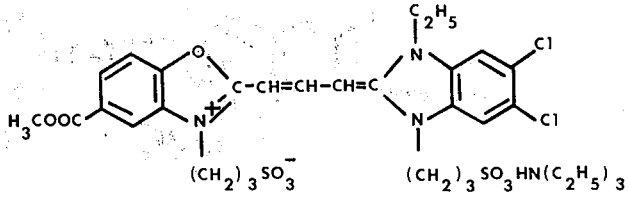

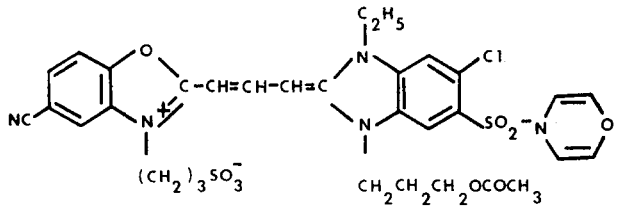
and
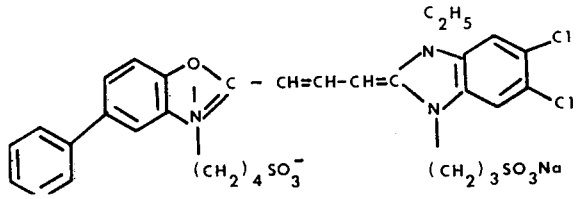
General Formula II
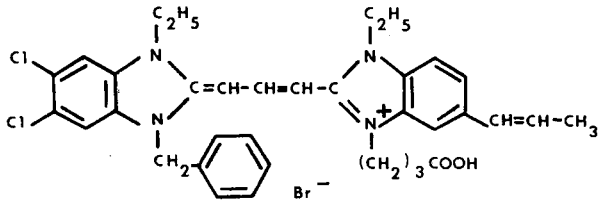
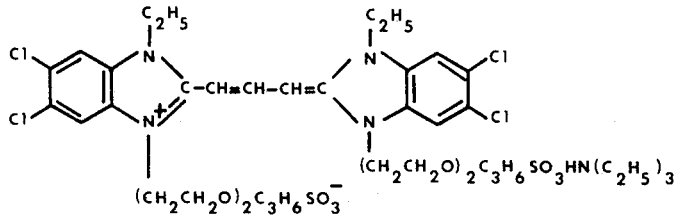
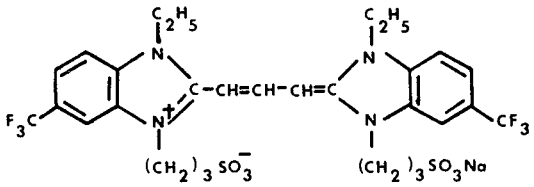
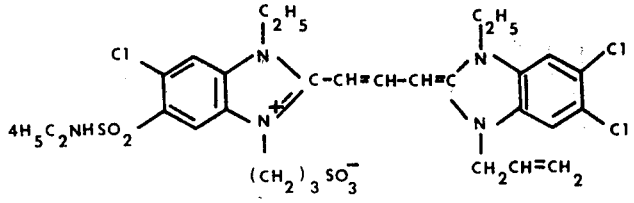

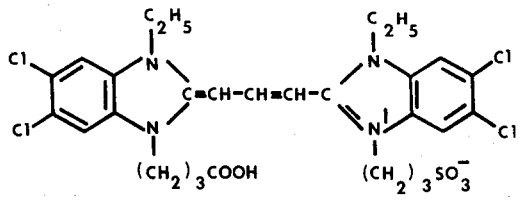

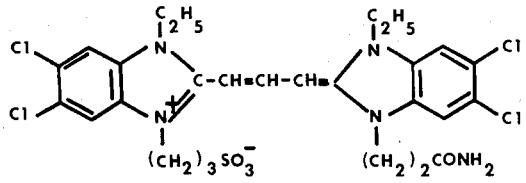

and

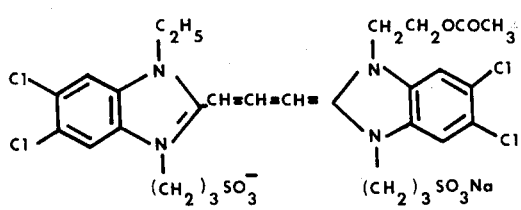

17. A sensitized gelatino-silver halide emulsion containing a super-sensitizing combination of at least one sensitizing dye of the General Formula:

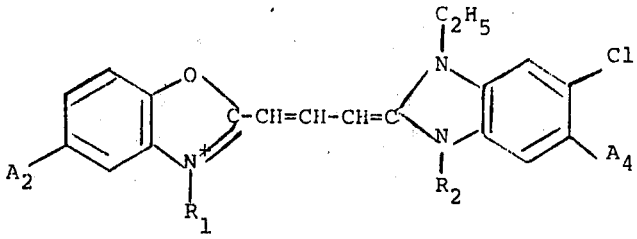

wherein $A_2$ is a member selected from the group consisting of a phenyl group, an alkoxycarbonyl group in which the alkyl moiety thereof has up to 3 carbon atoms, an alkyl group having up to 3 carbon atoms, an alkoxy group, a hydroxy group, a trifluoromethyl group, and a halogen atom; $R_1$ and $R_2$ are each a member selected from the group consisting of an alkyl group having up to 6 carbon atoms and a substituted alkyl group having a sulfo group thereon in which the alkyl moiety thereof has up to 6 carbon atoms, at least one of $R_1$ and $R_2$ being a substituted alkyl group having a sulfo group thereon; and wherein $A_4$ is a member selected from the group consisting of alkylsulfonyl, alkylsulfamoyl, N-di-substituted amino sulfonyl, alkylcarbamoyl, N-di-substituted carbamoyl, cyano, alkoxycarbonyl or halogen; and at least one sensitizing dye of the General Formula:

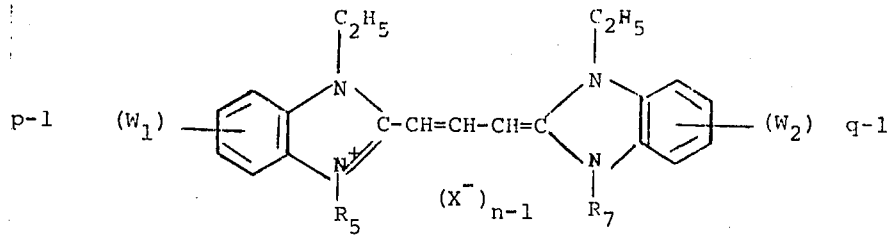

wherein $W_1$ and $W_2$, which may be the same or different, are each a member selected from the group consisting of a halogen atom, an alkoxycarbonyl group, a trifluoromethyl group and a cyano group; *p* and *q* are 1, 2 or 3; $R_5$ and $R_7$ are each a member selected from the group consisting of an alkyl group having up to 6 carbon atoms and having a member selected from the group consisting of a sulfo group and a carboxy group thereon; X is an acid anion and *n* is an integer of from 1 to 2, *n* being 1 when an intramolecular salt is formed.

* * * * *

UNITED STATES PATENT OFFICE

CERTIFICATE OF CORRECTION

PATENT NO. : 3,947,275
DATED : March 30, 1976
INVENTOR(S) : Keisuke SHIBA, Akira SATO, Akira OGAWA It is certified that error appears in the above-identified patent and that said Letters Patent are hereby corrected as shown below:

IN THE HEADING:

ADD:

Foreign Application Priority Data

May 1, 1970 Japan..... 37394

Signed and Sealed this
*eighth* Day of *June 1976*

[SEAL]

*Attest:*

RUTH C. MASON
*Attesting Officer*

C. MARSHALL DANN
*Commissioner of Patents and Trademarks*